US006953136B2

(12) United States Patent
Paraskevas

(10) Patent No.: US 6,953,136 B2
(45) Date of Patent: Oct. 11, 2005

(54) DRAWING MACHINE

(75) Inventor: Elefterios Paraskevas, Aachen (DE)

(73) Assignee: EJP Maschinen GmbH, Baesweiler (DE)

( * ) Notice: Subject to any disclaimer, the term of this patent is extended or adjusted under 35 U.S.C. 154(b) by 0 days.

(21) Appl. No.: 10/615,717

(22) Filed: Jul. 9, 2003

(65) Prior Publication Data

US 2004/0108352 A1 Jun. 10, 2004

(51) Int. Cl.[7] ..... B65H 17/34
(52) U.S. Cl. ..... 226/172; 226/173; 226/168
(58) Field of Search ..... 226/168, 170, 226/171, 172, 173

(56) References Cited

U.S. PATENT DOCUMENTS

| | | | | |
|---|---|---|---|---|
| 1,911,157 A | | 5/1933 | Leech | |
| 3,116,865 A | | 1/1964 | Lehnert et al. | |
| 4,008,840 A | * | 2/1977 | Lorenz et al. | 226/173 |
| 5,326,010 A | * | 7/1994 | Moras | 226/172 |
| 5,346,112 A | | 9/1994 | Ziemek et al. | |
| 5,533,658 A | * | 7/1996 | Benedict et al. | 226/172 |
| 5,775,417 A | * | 7/1998 | Council | 166/77.3 |
| 6,450,386 B1 | * | 9/2002 | Hessberger et al. | 226/172 |

FOREIGN PATENT DOCUMENTS

| | | |
|---|---|---|
| DE | 24 49 579 A | 4/1976 |
| DE | 27 32 870 A | 2/1979 |
| DE | 31 46 931 A | 6/1983 |

* cited by examiner

*Primary Examiner*—Kathy Matecki
*Assistant Examiner*—Evan Langdon
(74) *Attorney, Agent, or Firm*—McCarter & English, LLP

(57) ABSTRACT

A drawing machine includes a drawing die and a continuously working drawing device, the drawing device comprising only one closed drawing member that is guided around axis-parallel wheels and is driven in a controlled manner via at least one of the wheels. The drawing member is linked with clamping devices carrying clamping chucks that are controlled and moved towards one another and apart from another to grip a wire, tube or profile to be drawn. In an embodiment, the clamping chucks are retained by retainer elements that extend through a drawing element linked with the clamping device.

9 Claims, 13 Drawing Sheets

DRAWING MACHINE

FIELD OF THE INVENTION

The invention relates to a drawing machine with a draw die and a continuously-working drawing device.

BACKGROUND OF THE INVENTION

Such drawing machines are already known, with which the wire can be continuously drawn. For this purpose the wire is clamped and drawn between the lower strand of an upper enclosed circulating chain and the upper strand of an enclosed circulating chain. These known drawing machines require considerable design effort and expenditure. In addition to that, they are prone to a high degree of wear, since in order to clamp the wire a force is applied to the chains transverse to their direction of run. This type of clamping also leads to a substantial development of burdensome noise.

SUMMARY OF THE INVENTION

The problem of the present invention lies in avoiding the disadvantages of these known drawing machines and ensuring reliable drawing of wire, pipes, and/or profiles.

This problem is resolved according to the present invention by a drawing machine having a drawing device that exhibits only one enclosed drawing element, that this drawing element is guided around axis-parallel wheels, and is moved in a controlled manner by at least one of the wheels, that the drawing element is connected to clamping devices carrying clamping chucks, and that the clamping chucks are capable of being moved towards and away from one another in a controlled manner for the purpose of taking up the wire, pipe, or profile which is to be drawn.

Advantageous further embodiments of this drawing machine can be derived in particular from the claims.

BRIEF DESCRIPTION OF THE DRAWINGS

For a more complete understanding of the present invention, reference is made to the following detailed description of the exemplary embodiments considered in conjunction with the accompanying drawings, in which.

DETAILED DESCRIPTION OF THE INVENTION

Figure 1:
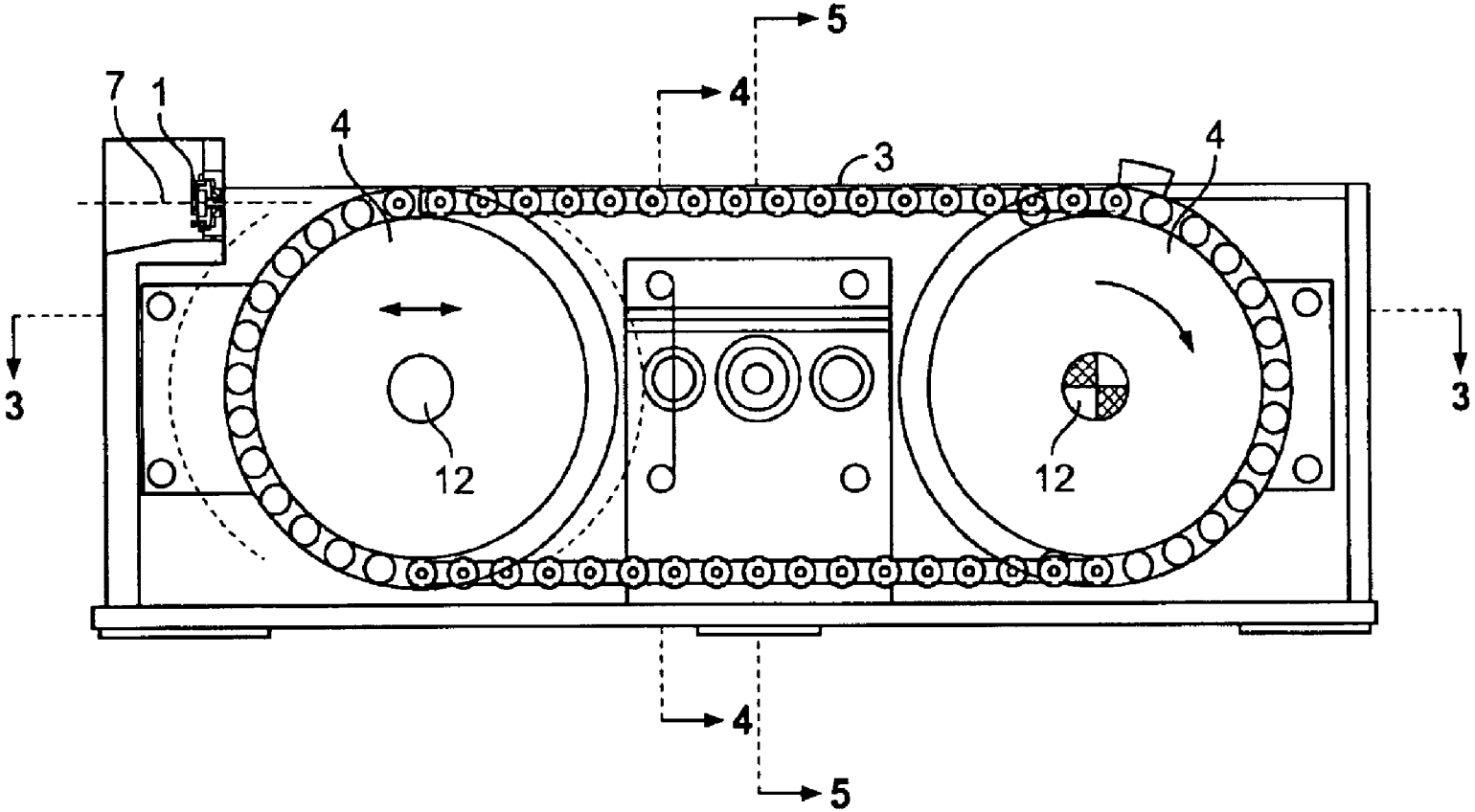
FIG. 1 is a side view of an embodiment in which the drawing element is designed as a chain.
Figure 2:
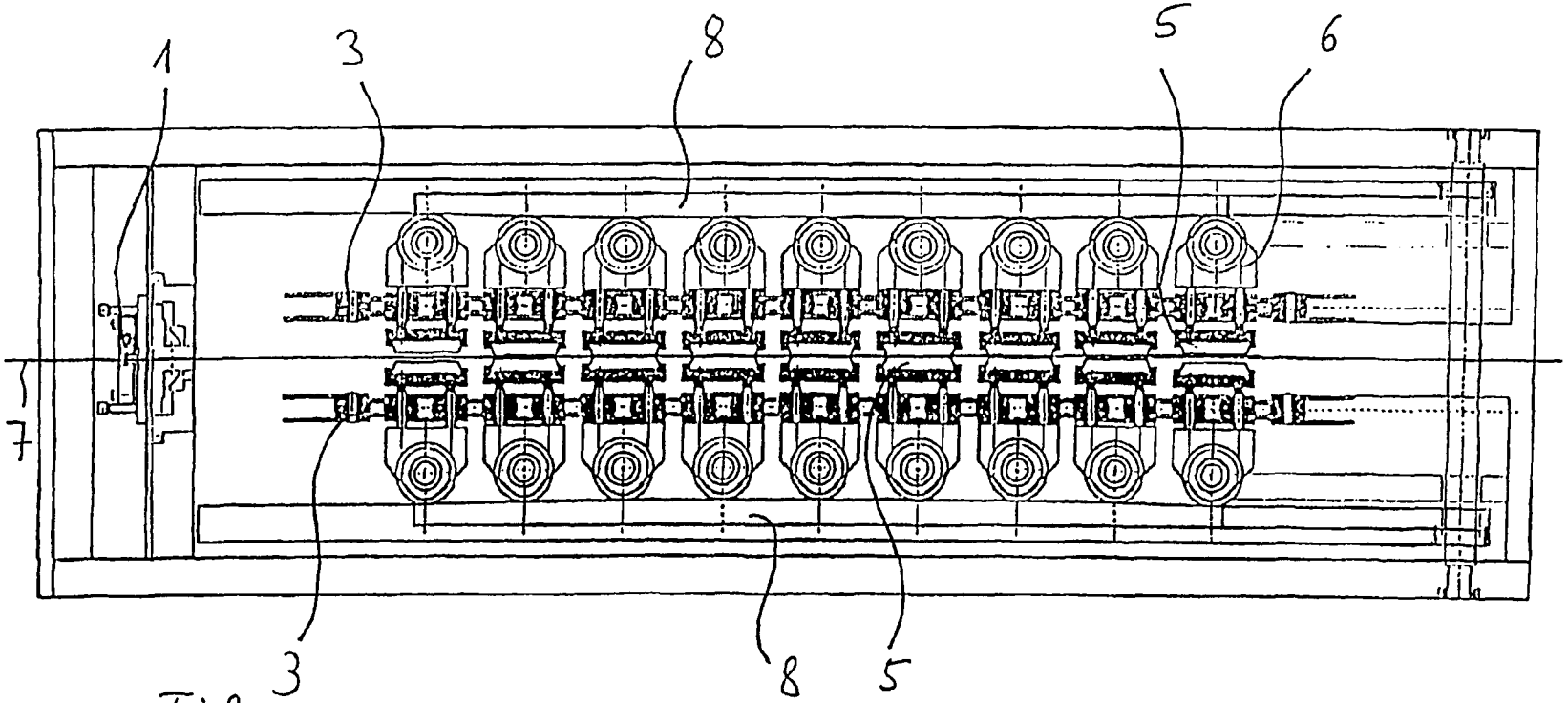
FIG. 2 is a plan view of the embodiment according to FIG. 1.

The embodiments of the drawing machine according to the invention represented in the drawings exhibit concordantly two chain-type drawing elements 3, which in each case run over two wheels 4, one of which is driven in each case. The driven wheels 4, like the two non-driven wheels 4, are located in each case on a common shaft 12. The chain-type drawing elements 3 are connected in each case to several clamping devices 6. In each case, clamping devices 6 belonging to two drawing elements 3, which are to be differentiated, interact in order to take up a wire 7 with their clamping chucks 5. The clamping devices 6 exhibit rollers 13, which, because of the movement of the drawing elements 3 pertaining to them, are guided on control curves 8. The clamping chuck 5 of each clamping device 6 is held by two retaining bars 11, which are guided by the chain-type draw element 3 pertaining to them. The retaining bars 11 have the effect, on the one hand, that the clamping devices are driven by the draw element 3 pertaining to them; on the other, interacting clamping chucks 5 can be moved towards one another by means of the retaining bars 11 without the individual drawing element 3 exerting a force transverse to the direction of run of the drawing element 3. That is to say, the movement of the clamping chucks 5 towards one another or away from one another is decoupled from the drawing elements 3, as a result of which the drawing elements 3 exhibit a low degree of wear.

The control curves 8 are designed in such a way that the clamping devices 6 are moved towards one another in the starting area of the upper strand, so as to take up the wire 7, and are moved away from one another, releasing the wire 7, towards the end of this strand.

Figure 3:
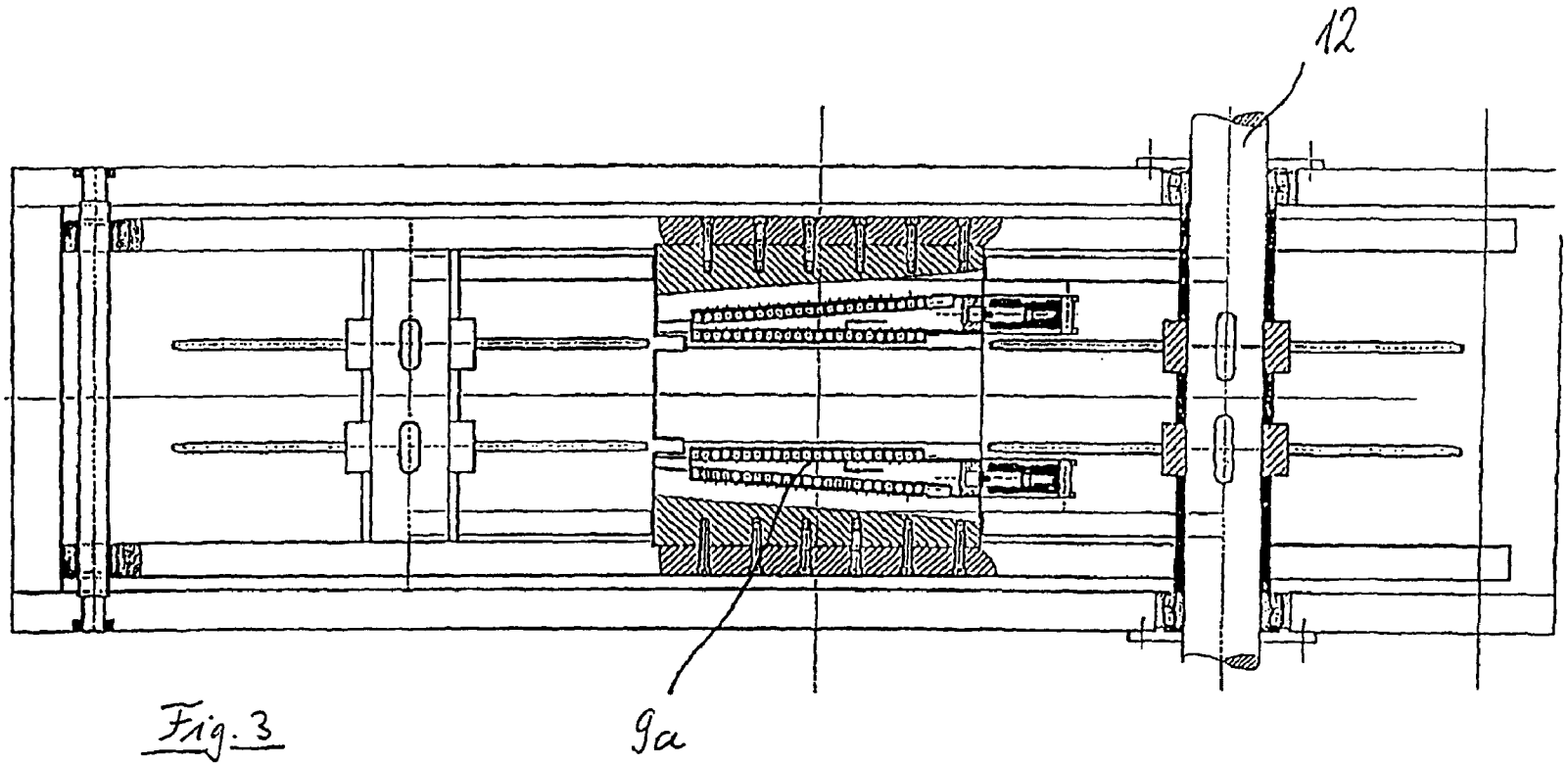
FIG. 3 is a detail view relating to the adjustment of the chain elements in order to increase the clamping force according to the line from A—A in FIG. 1.
Figure 4:
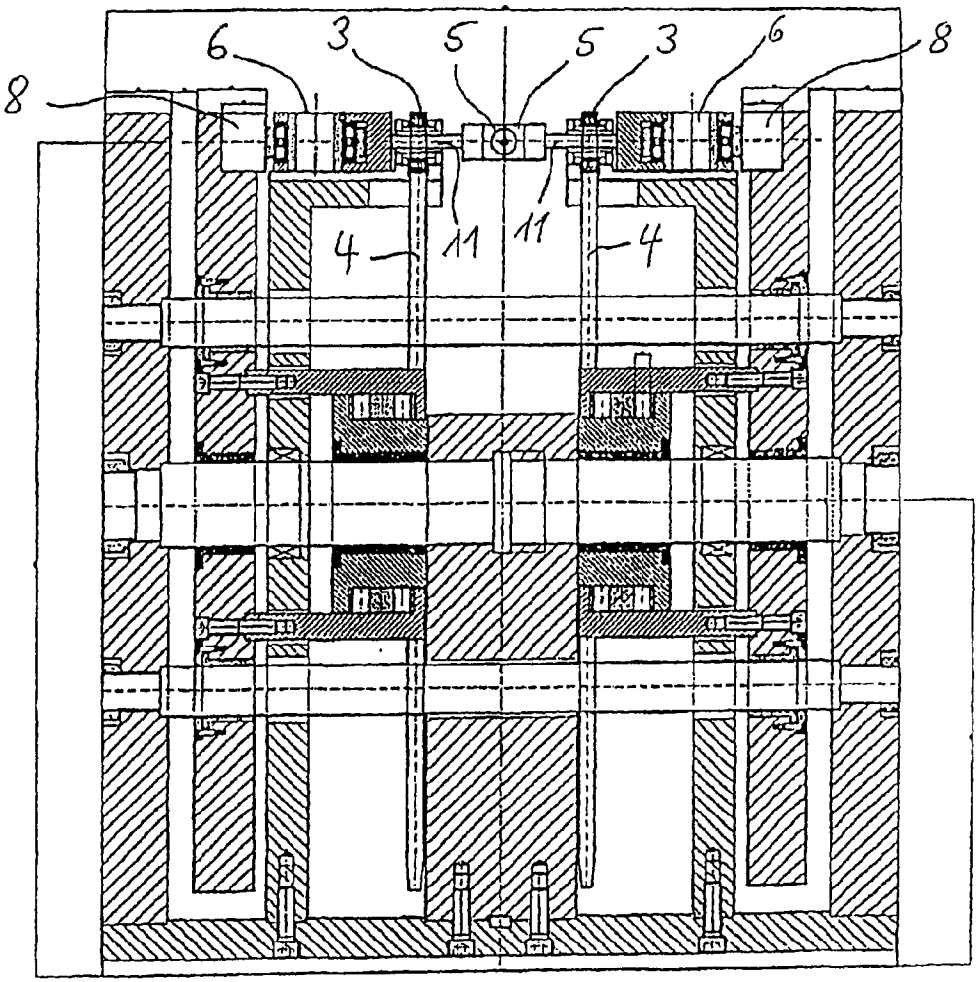
FIG. 4 is a horizontal section through the representation according to FIG. 3 according to the line B—B in FIG. 1.
Figure 5:
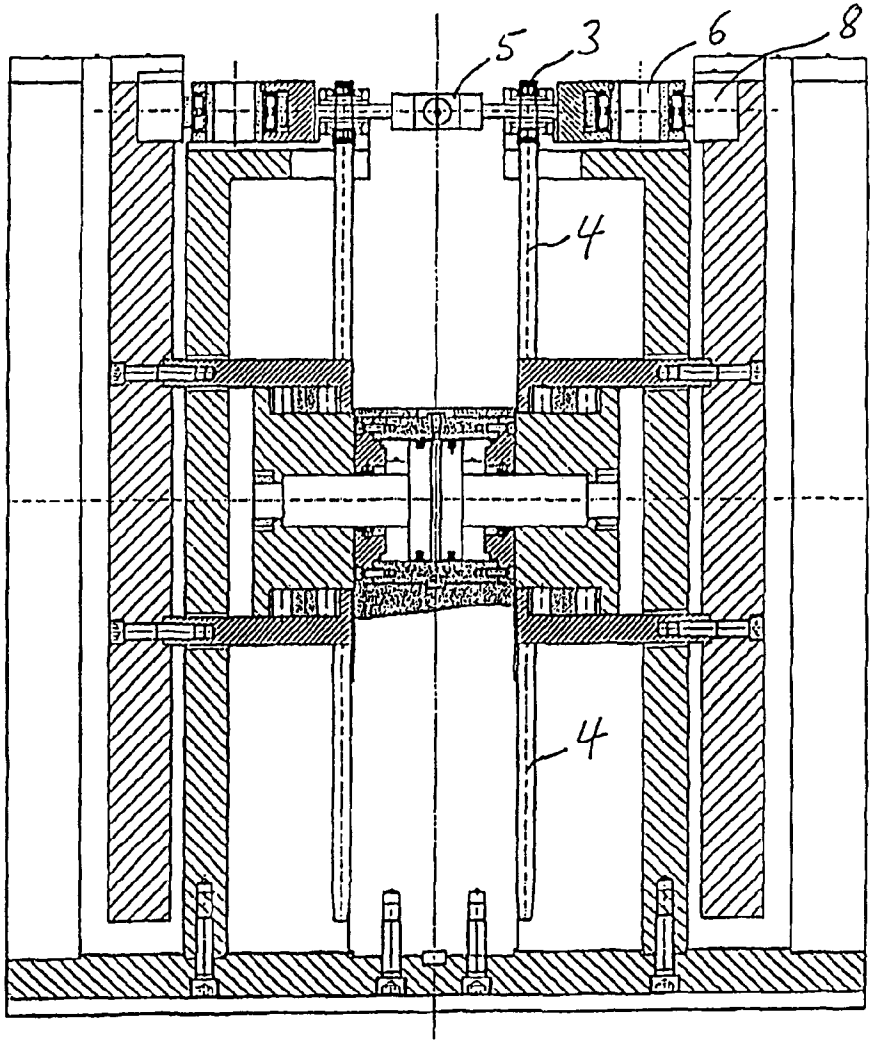
FIG. 5 is a section according to the line C—C in FIG. 1 with the clamping chucks closed.
Figure 6:
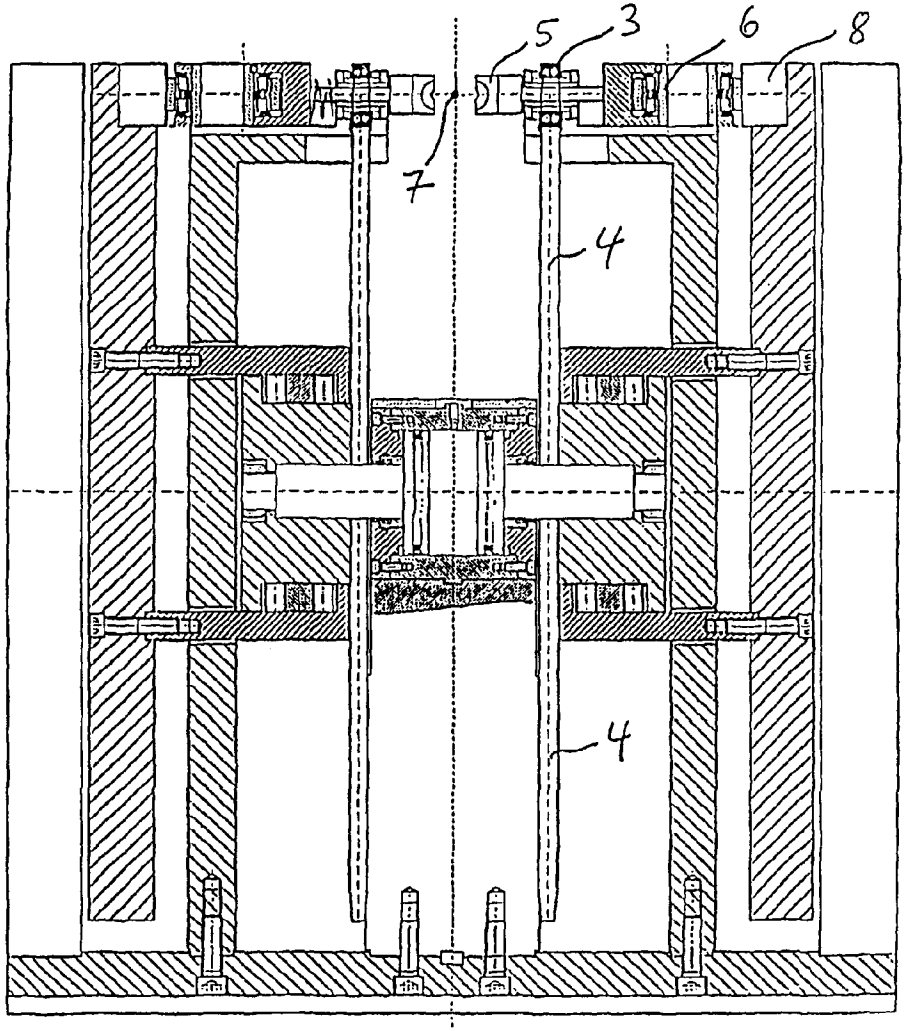
FIG. 6 is a representation corresponding to FIG. 5 with the clamping chucks open.
Figure 7:
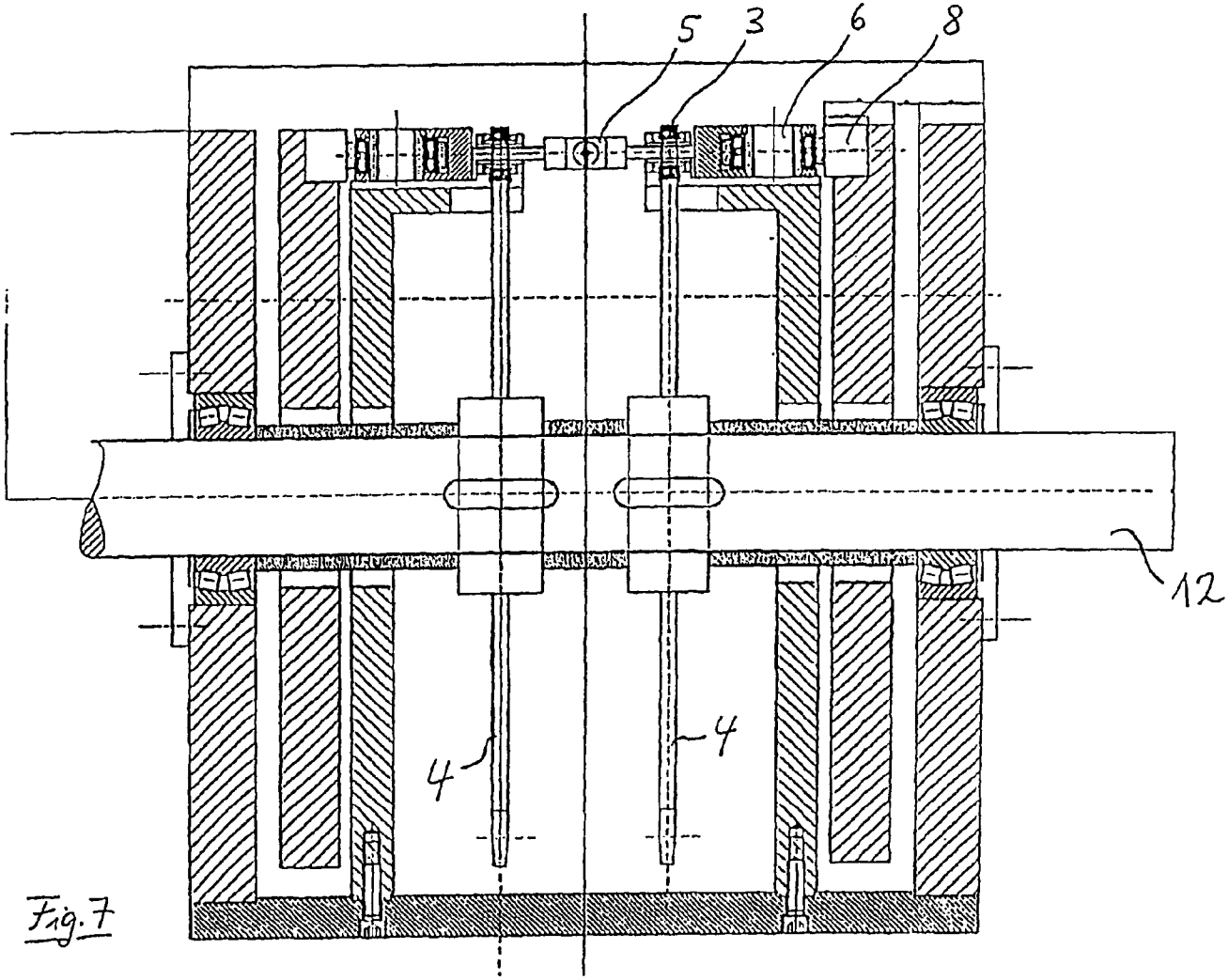
FIG. 7 is an axial section through the driving wheels and the clamping devices.
Figure 8:
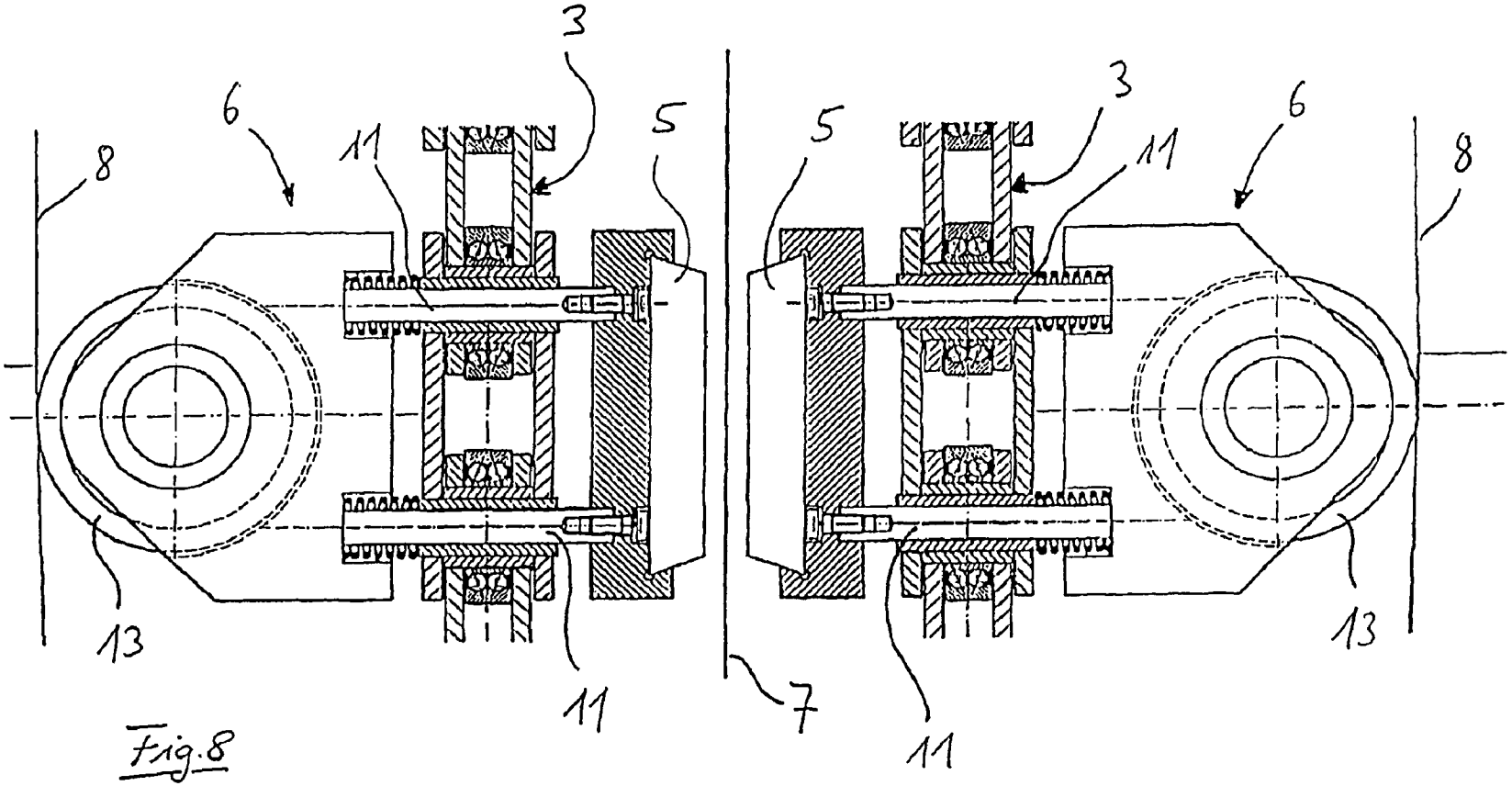
FIG. 8 is an embodiment relating to the controlling of the clamping devices by means of control curve and recovery by springs.
Figure 9:
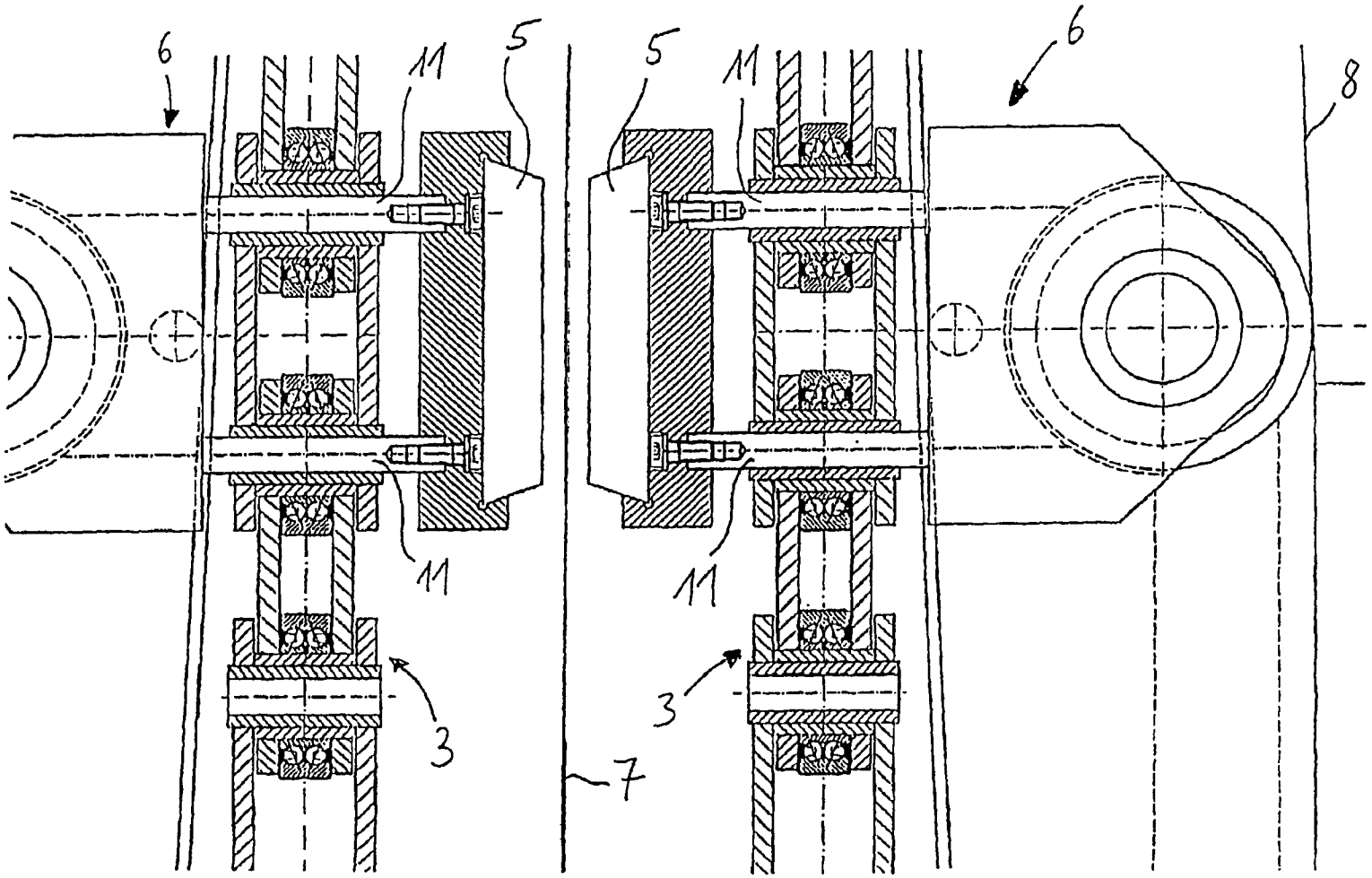
FIG. 9 is a further embodiment relating to the controlling of the clamping devices by control curves and recovery likewise by control curves.
Figure 10:
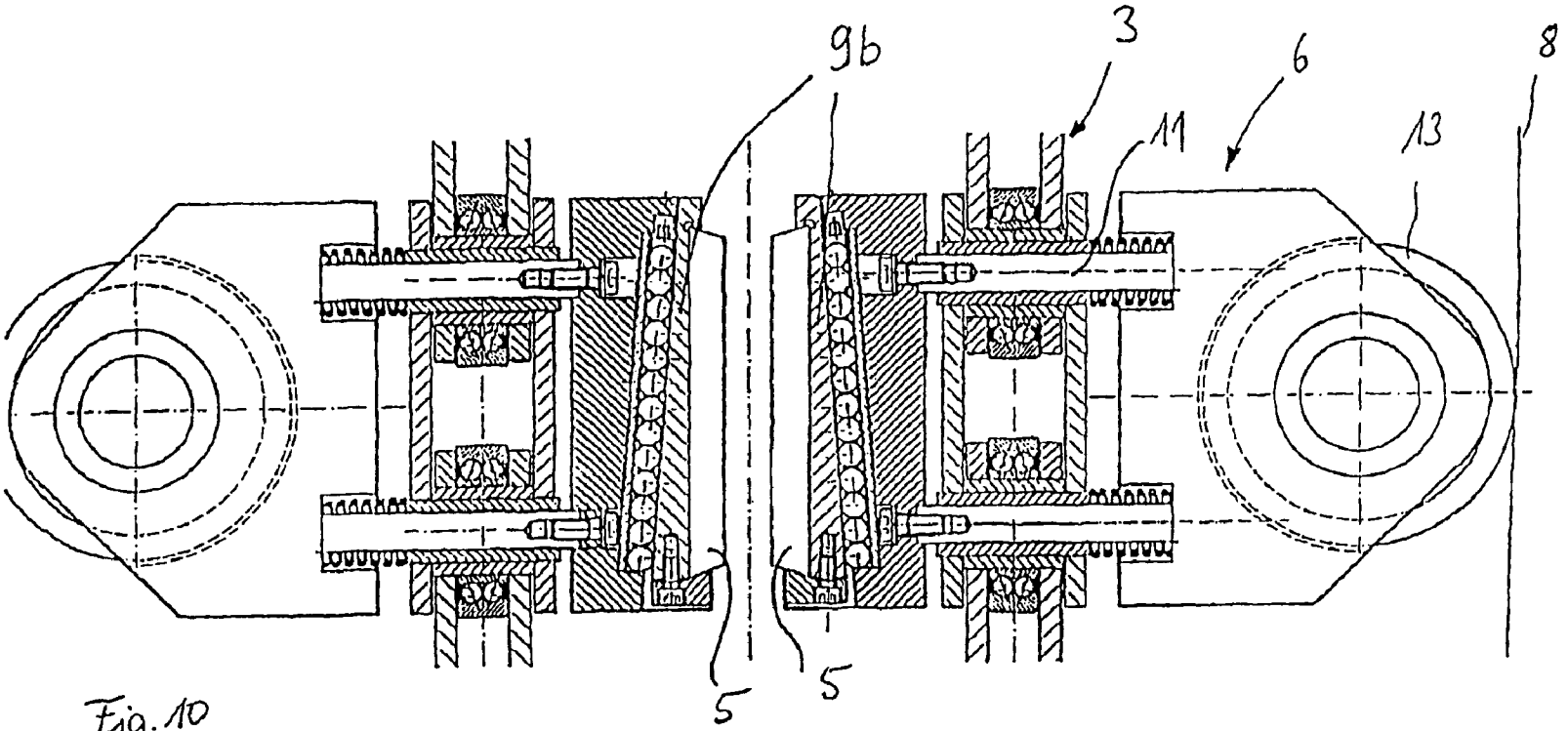
FIG. 10 is a representation similar to FIG. 8 with wedge elements to increase the clamping effect.
Figure 11:
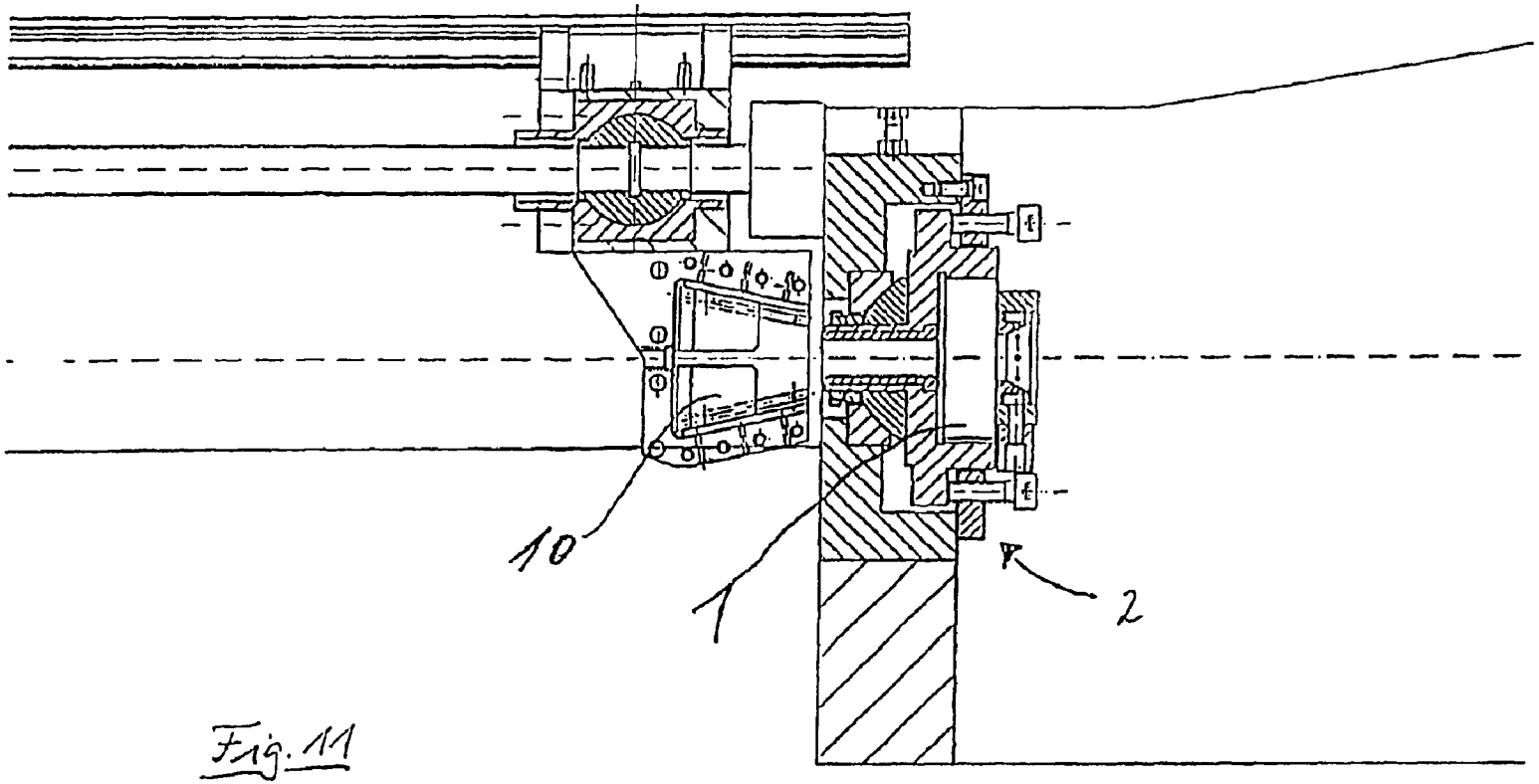
FIG. 11 is a section relating to the wire feed with draw die.
Figure 12:
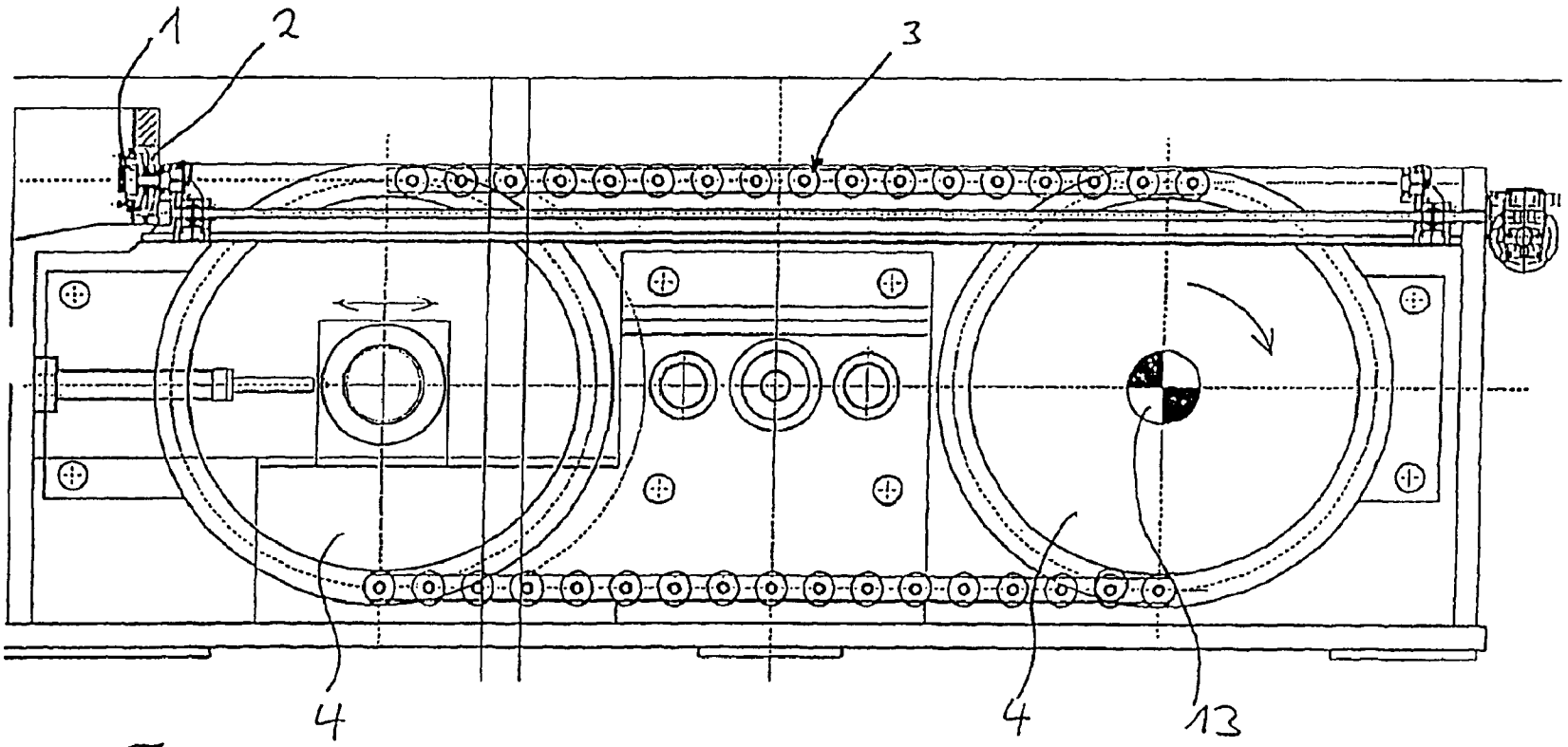
FIG. 12 is a representation similar to FIG. 1 with a device for the drawing in of the wire.
Figure 13:
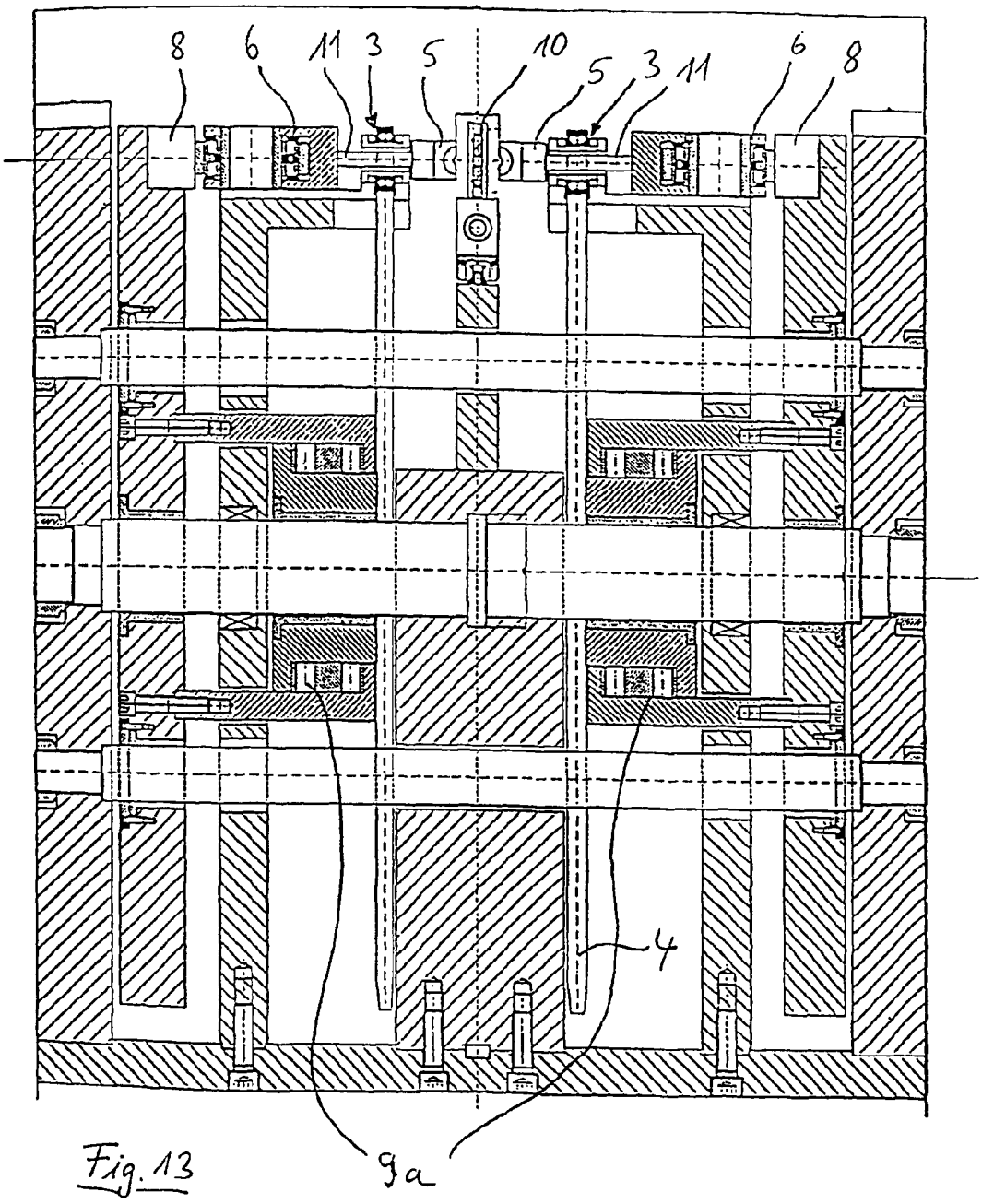
FIG. 13 is a drawing machine with opened clamping chucks and passing gripper tongs.

In order to increase the clamping effect, on the one hand wedge elements 9*a* are provided for, taking effect on the position of the control curves (see FIGS. 3 and 13), or clamping chuck wedge elements 9*b* arranged in the individual clamping devices 6 (see FIG. 10). Both with the wedge elements 9*a* according to FIG. 13 or FIG. 3 respectively, as well as with the wedge elements 9*b* according to FIG. 10, a relative movement takes place when the wire 7 is taken up.

What is claimed is:

1. A drawing machine, comprising a single closed drawing organ having a first drawing element and a second drawing element positioned substantially parallel to said first drawing element, a plurality of first clamping devices connected to said first drawing element, each of said first clamping devices including a first clamping chuck, a plurality of second clamping devices connected to said second drawing element, each of said second clamping devices including a second clamping chuck, each of said first and second clamping devices having a retaining element adapted to move each of said first and second clamping chucks between a closed position, in which said first and second clamping chucks are proximate to each other, and an open position, in which said first and second clamping chucks are remote from each other; a first pair of wheels adapted to guide said first drawing element; and a second pair of wheels adapted to guide said second drawing element, said retaining element of said first clamping device engaging through said first drawing element in a direction parallel to the axis of said first pair of wheels, and said retaining element of said second clamping device engaging through said second drawing element in a direction parallel to the axis of said second pair of wheels.

2. The drawing machine of claim 1, wherein said first and second drawing elements are chains.

3. The drawing machine of claim 1, further comprising control curves adapted to control the movement of said first and second clamping chucks.

4. The drawing machine of claim 1, wherein said first and second clamping devices include two wedge elements capable of being displaced in relation to one another, one of which is displaced relative to the other in the event of friction contact, whereby an increased wedging and clamping effect is imposed.

5. The drawing machine of claim 1, wherein at least one of said first pair of wheels is adapted to drive said first drawing element.

6. The drawing machine of claim 5, wherein at least one of said second pair of wheels is adapted to drive said second drawing element.

7. The drawing machine of claim 1, wherein one of said first clamping chucks cooperates with one of said second clamping chucks corresponding to said one of said first clamping chucks so as to take up wire.

8. The drawing machine of claim 1, wherein one of said first clamping chucks cooperates with one of said second clamping chucks corresponding to said one of said first clamping chucks so as to take up pipe.

9. The drawing machine of claim 1, wherein one of said first clamping chucks cooperates with one of said second clamping chucks corresponding to said one of said first clamping chucks so as to take up profile.

* * * * *

UNITED STATES PATENT AND TRADEMARK OFFICE

CERTIFICATE OF CORRECTION

PATENT NO. : 6,953,136 B2
APPLICATION NO. : 10/615717
DATED : October 11, 2005
INVENTOR(S) : Elefterios Paraskevas It is certified that error appears in the above-identified patent and that said Letters Patent is hereby corrected as shown below:

On the Title Page, Item (30)
-- [30] Foreign Application Priority Data
Jan. 11, 2001 [DE] ……...10101199.7
Jan. 3, 2002 [WO]……...PCT/DE02/00002 --

Signed and Sealed this

Fourth Day of November, 2008

JON W. DUDAS
*Director of the United States Patent and Trademark Office*